US006536706B1

(12) United States Patent
St. Germain et al.

(10) Patent No.: US 6,536,706 B1
(45) Date of Patent: Mar. 25, 2003

(54) SELF-LIFTING SHAFTLESS UNWIND STAND

(75) Inventors: Patrick C. St. Germain, Iron River, WI (US); Vernon C. Wickman, Port Wing, WI (US)

(73) Assignee: Specialty Systems Advanced Machinery, Inc., Iron River, WI (US)

( * ) Notice: Subject to any disclaimer, the term of this patent is extended or adjusted under 35 U.S.C. 154(b) by 0 days.

(21) Appl. No.: 09/947,621

(22) Filed: Sep. 6, 2001

(51) Int. Cl.[7] ..... B65H 19/00
(52) U.S. Cl. ..... 242/559.1
(58) Field of Search ..... 242/559, 559.1, 242/559.2, 533.4, 533.5; 414/911

(56) References Cited

U.S. PATENT DOCUMENTS 4,706,905 A * 11/1987 Torres ..... 242/559
4,893,763 A * 1/1990 Wales et al. ..... 242/559.1

* cited by examiner

*Primary Examiner*—John Q. Nguyen
(74) *Attorney, Agent, or Firm*—Olson & Hierl, Ltd.

(57) ABSTRACT

An apparatus for lifting a roll of previously wound material and for unwinding the material from the roll is disclosed. The apparatus includes a hollow column around which a lift arm assembly is moved from a load position to an unwind position. A lifting mechanism for lifting the roll after it is loaded at the load position is also provided. A plurality of lift arm assemblies can be provided so that a stand-by roll can be loaded onto the apparatus to be quickly rotated into an unwinding position. The lift arm assembly supports the roll without the use of a shaft through the core of the roll. A drive motor is provided which includes a splined shaft for engaging the roll and turning the roll to unwind the material therefrom.

6 Claims, 7 Drawing Sheets

SELF-LIFTING SHAFTLESS UNWIND STAND

FIELD OF THE INVENTION

The present invention relates generally to an apparatus for unwinding material from a previously wound roll and, more particularly, to an improved apparatus onto which rolls of sheet form material and the like can be loaded in preparation for unwinding, and then quickly and easily lifted and rotated from a loading position into an unwinding position when a previously loaded roll has been unwound.

BACKGROUND OF THE INVENTION

Many products are manufactured from elongated sheet or stock material that is shipped and stored in the form of a roll or coil. Continuous strips or webs of thin, flexible material are commonly provided on storage rolls that are subsequently unwound for production of items made from these materials. Examples of these materials are plastic film, metal foil, and paper. Other materials such as cable or wire are also wound onto rolls.

During the manufacture of paper products such as napkins, newspapers, and magazines, for example, very large storage rolls of paper are used to provide the stock material from which the paper items are produced. The storage rolls are then unwound for further processing such as cutting, folding, or printing.

When a roll is being unwound so that the material can be further processed, it is desirable to quickly change to a new roll once the previous roll is spent. However, the large and heavy storage rolls of stock material are difficult to handle. Also, the manufacturing process must be stopped so that the spent roll can be removed and replaced by a new roll. The time spent unloading and reloading the machine results in decreased production of the final product.

A apparatus that accepts subsequent or stand-by rolls of stock material ready for quick movement into an unwinding position is highly desirable because of the savings in time that such a machine can provide. The stand-by roll can be quickly moved into place, and the unwinding and subsequent processes can proceed with minimal interruption.

The placement of a roll of material onto a shaft or spindle, which is then mounted onto a machine for unwinding of the roll, is another time-consuming manufacturing step. The added steps of inserting the shaft into the core of the roll and then removing it when the roll is unwound results in additional time spent setting up the machine, which also decreases productivity. An apparatus machine that can hold and unwind a roll of material without a shaft or spindle would be advantageous as well.

Thus, there continues to be a need for a method and apparatus for unwinding material from a roll that allows the loading of subsequent rolls of material which are then quickly rotated into position for unwinding. Also, there is a need for a method and apparatus that will increase the speed of the unwinding process by eliminating time-consuming steps, thus increasing productivity. The present invention meets these desires.

SUMMARY OF THE INVENTION

A roll unwinding apparatus embodying the present invention efficiently performs lifting and turning operations on a roll of material to unwind the material from the roll.

The material on the roll may be a thin flexible web of material such as foil, plastic film, fabric, or paper.

Alternatively, the material may be an elongated strip or length of material such as, for example, wire, cable, string, or rope. For simplicity of explanation, references herein to paper as the material on the roll should be construed to include any material capable of being wound onto a roll and subsequently unwound.

The unwinding machine of the present invention comprises a base, a hollow column extending upwardly from the base, and a lift carriage mounted for movement along and around the column. A rotary track is provided around the column proximal to the column's upper end.

The lift carriage includes a lift arm assembly for supporting and rotatably holding the roll of material. The lift arm assembly includes a pair of vertically oriented, parallel support arms which accept and support the roll of material during the loading and unwinding operations, respectively. The support arms of the pair are movable relative to one another other along a horizontal support arm track. Each support arm of the pair has a lower end for supporting the roll of material and an upper end that rests on a support arm track. A spindle is inwardly located at the lower end of each support arm of the pair for insertion into the core of a roll of material.

In operation, the support arms move away from one another along the horizontal support arm track to accept the core of a roll on the spindles located therebetween. The lift arms are then moved towards one another and the spindles inserted into the core to releasably and rotatably hold the roll between the support arms. The support arms of the lift arm assembly thus support the roll both during the unwind operation and during movement of the roll between the load and unwind positions on the turret.

The lift arm assembly is movable both vertically along the hollow column and rotatably around the column in conjunction with the rotary track. In the preferred embodiment described herein, the lift arm assembly moves between "load" and "unwind" positions around the hollow column. The loading and unwinding operations of a given roll take place at these two positions, respectively.

A lift pin is provided within the column. The lift pin, motor driven by a ball screw, moves vertically along the length of the column between the column's base and the rotary track. The lift pin is operably associated with the lift arm assembly to raise and lower the assembly between these two locations.

The full roll of material is loaded into the lift arm assembly when the assembly is located proximal to the column's base (the "load" position). The lift arm assembly is then raised by the lift pin to the rotary track and then rotated 180 degrees around the hollow column on the rotary track into the "unwind" position, where the roll is then unwound. After the roll is unwound, the lift arm assembly, having the empty core thereon, is rotated 180 degrees back around the hollow column on the rotary track, where it once again engages the lift pin. After engaging the lift pin, the lift arm assembly is then lowered vertically along the column length from the rotary track to the position proximal to the base plate (load position).

The preferred embodiment described herein further comprises a drive motor for turning the roll to unwind the material therefrom once it has been loaded and moved into the unwinding position. The motor, attached to the hollow column, has a drive shaft extending therefrom that is co-axial with the core of the roll of material when the core is located in the unwind position on the column.

The drive shaft is splined to allow for axial translation of the shaft between the drive motor and material core. Such translation allows the shaft to both extend from the motor (to engage the spindle during the unwind operation) and retract from the spindle back to the motor (when moving the roll to or from the unwind location on the turret).

In overall operation, the lift arm assembly is initially placed at the "load" position and the support arms of the lift arm assembly are moved apart to accept placement of a full roll of material therebetween. The support arms are then moved towards one another and the spindles are inserted into the core to releasably and rotatably hold the roll between the support arms. The lift pin then engages the lift arm assembly to lift the assembly vertically from a location proximal to the base plate of the column up to the rotary track, located proximal to the column's upper end. Upon reaching the rotary track, the lift arm assembly is then rotated 180 degrees around the column on the rotary track to the "unwind" position.

Once the lift arm assembly, having the full roll loaded thereon, is placed in the "unwind" position, the splined drive shaft is axially extended from the drive motor to the spindle which has been inserted into the core. Upon engaging the spindle, the drive motor is started for rotation of the roll during the unwind operation. After all material has been unwound from the roll, the drive shaft is disengaged from the spindle and retracted back to the motor. The lift arm assembly, holding the empty core thereon, is rotated back 180 degrees on the rotary track of the column to the lift pin.

Upon engaging the lift pin, the lift arm assembly is then lowered from the rotary track back to the "load" position, proximal to the column's base plate. The support arms of the lift arm assembly are them moved apart from one another and the empty core removed from therebetween. A full roll of material is then placed between the support arms of the lift arm assembly. The lift arm assembly is then moved again to the unwind position, via the lift pin and rotary track, where the unwind operation is repeated.

More than one lift arm assembly may be provided in the preferred embodiment of the present invention. When additional lift arm assemblies are provided, a subsequent roll (or rolls) can be loaded onto the machine in advance of being unwound. While a roll is in the process of being unwound in the "unwind" position on the column, a subsequent, full roll can be loaded onto the machine in the "load" position, and held there until the roll located in the "unwind" position is fully unwound.

The subsequent, full roll is then moved from the "load" position to the rotary track via the lift pin. Upon reaching the rotary track, the lift arm assemblies, holding the full roll and the empty core, respectively, are each rotated around the column so that the full roll is moved into the "unwind" position from the lift pin while the empty core is moved from the "unwind" position and into engagement with the lift pin. The unwinding of the full roll can thus commence while the lift pin lowers the empty core towards the column's "load" position (for subsequent replacement with another full roll).

There are other advantages and features of the present invention which will be more readily apparent from the following detailed description of the preferred embodiment of the invention, the drawings, and the appended claims.

DESCRIPTION OF THE PREFERRED EMBODIMENTS

Figure 1:
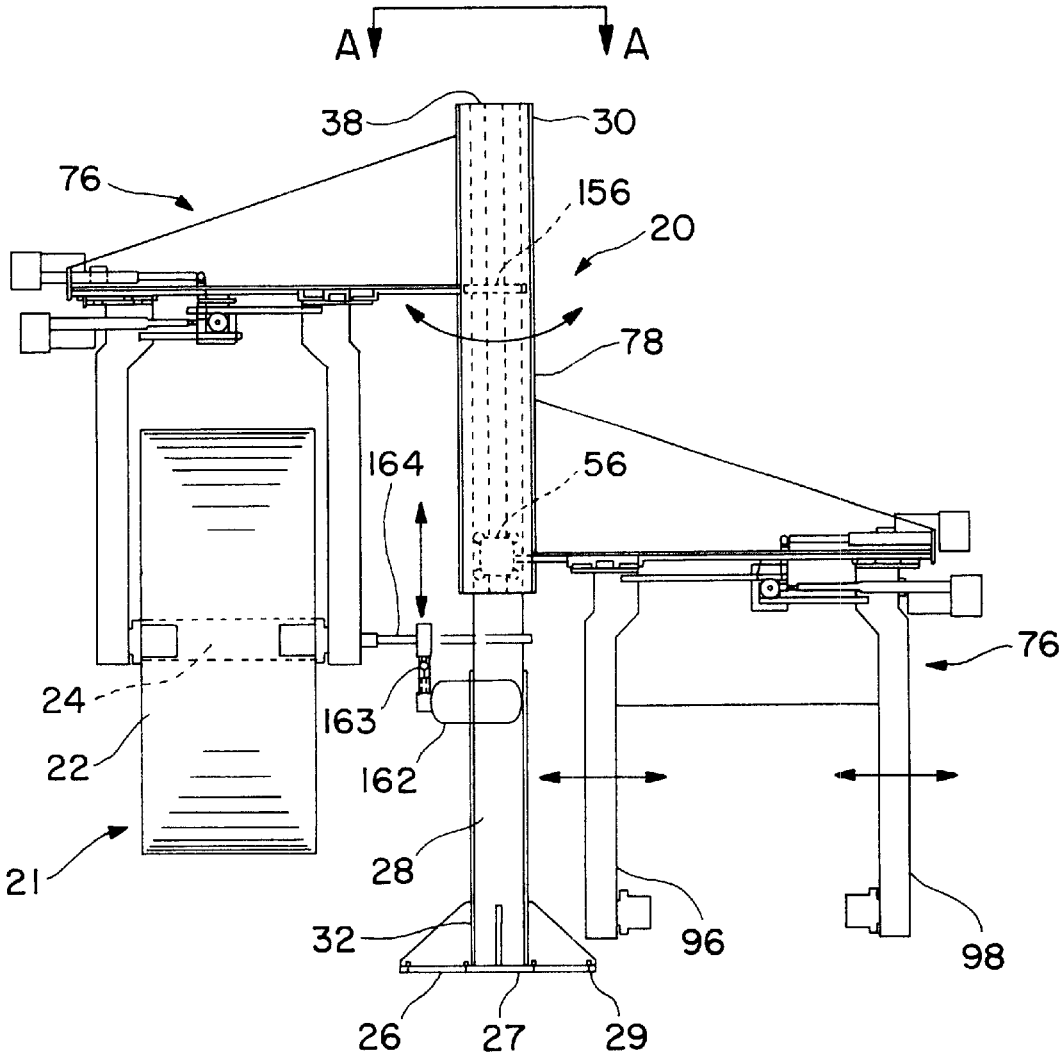
FIG. 1 is a front elevational view of an unwinding apparatus embodying the present invention.

The invention disclosed herein is, of course, susceptible of embodiment in many different forms. Shown in the drawings and described hereinbelow in detail are preferred embodiments of the invention. It is to be understood, however, that the present disclosure is an exemplification of the principles of the invention and does not limit the invention to the illustrated embodiments.

For ease of description, an apparatus embodying the present invention is described hereinbelow in its usual assembled position as shown in the accompanying drawings and terms such as upper, lower, horizontal, longitudinal, etc., may be used herein with reference to this usual position. However, the machine may be manufactured, transported, sold, or used in orientations other than that described and shown herein.

Referring to FIG. 1, an unwinding apparatus 20 embodying the present invention provides a self-lifting, driven, shaftless unwind stand for lifting, moving, and unwinding a roll 21 of previously wound material 22. The roll 21 can include a hollow, cylindrical core 24 around which the material 22 is wound. The unwinding apparatus 20 of the present invention preferably comprises a base 26 having a hollow column 28 extending therefrom. A lift carriage 56 and associated drive screw 38 are disposed within the column for movement of the carriage 56 along the column's length. Coaxially disposed around the outer periphery of the column 28, proximal to the column's upper end, is a rotary track 156. A turret 78 is rotatably mounted to the column 28 for rotational movement around both the column 28 and rotary track 156.

A lift arm assembly 76 is slidably attached to the outside of the turret 28 for movement along the turret's length. The lift arm assembly 76 is operably associated with the lift carriage 56 so that the lift carriage can move the the lift arm assembly 76 along the length of both the column 28 and turret 78 between a lowered position to a raised position. When in a raised position, the lift arm assembly 76 becomes operably associated with the rotary track 156 to enable the lift arm assembly 76, together with the turret 78, to rotate 180 degrees around the column 28.

The lift arm assembly includes a pair of support arms 96 and 98 which accept and support the roll 21 of material therebetween when the assembly is in a lowered position. With the roll of material supported (loaded) between the support arms 96 and 98 of the lift arm assembly 76, the lift arm assembly and roll 21 of material can be lifted by the carriage 56 from the lowered position and moved along the length of both the column 28 and turret 78 to the raised position. Once in the raised position, the lift arm assembly 76 and roll of material 21, along with the turret 78, is rotated 180 degrees around the column 28 on the rotary track 156. After the roll of material is rotated around the column 28, the material 22 on the roll 21 can be unwound and processed.

Turning now to a more detailed discussion of the apparatus, FIG. 1 shows the unwinding machine 20 of the present invention includes a hollow column 28 that extends from a base 26. In the preferred embodiment, the base 26 can comprise a generally flat, horizontal piece of plate steel, or some other similar material having adequate rigidity. The base 26 can have a plurality of bores 27 therethrough to allow the base to be affixed to a floor with anchor bolts 29 or similar fasteners. Although the base of the preferred embodiment is comprised of a horizontal sheet of plate steel, one of ordinary skill in the art would understand that the base 26 can be comprised of other rigid materials having various other shapes or configurations. Base 26 can also be mounted to a linear slide if lateral movement of the unwinding machine is desired.

The hollow column 28, extending upwardly from the base 26, is essentially comprised of a rigid, hollow cylinder having a top end 30 and a bottom end 32. The column 28 may be comprised of steel or some other material having sufficient rigidity. Because the column of the preferred embodiment comprises a cylinder, the cross sectional shape of the column is circular. It is understood, however, that the column 28 may comprise other cross sectional shapes as well, including, for example, square, rectangular, hexaganol or other shapes.

The bottom end 32 of the turret cylinder 28 is secured to the base 26. While the preferred embodiment has the bottom end 32 of the turret cylinder 28 fixedly secured to the base 26 with welds, it is understood that the bottom end 32 of the cylinder 28 may also be removably secured to the base 26 through the use of bolts or similar fasteners (not shown).

Figure 2:
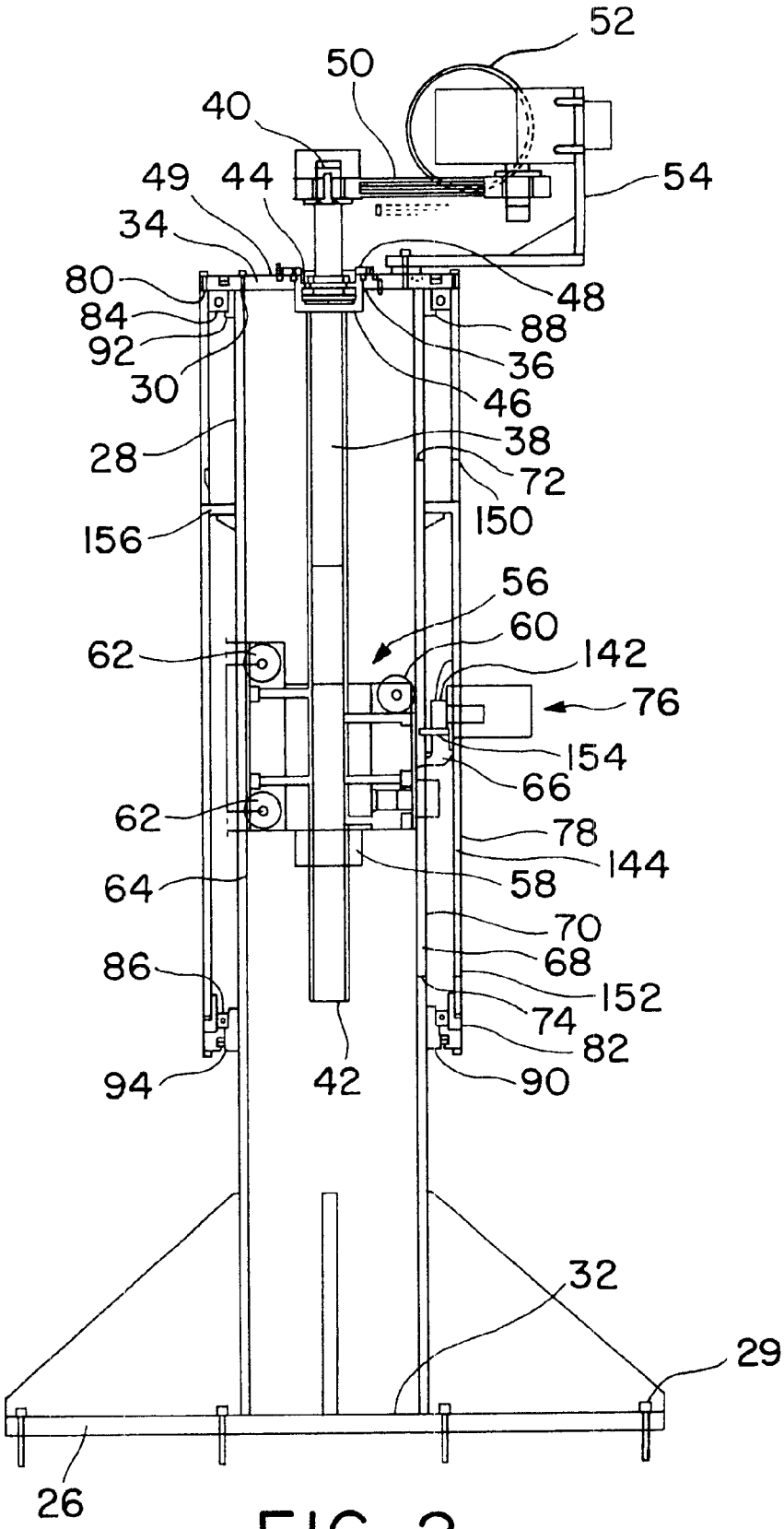
FIG. 2 is a front elevational view of the unwinding apparatus having the both the hollow column and turret vertically sectioned along plane A—A of FIG. 1 to show the carriage and drive screw located therein.

As illustrated in FIG. 2, a rigid top plate 34 is mounted to the top end 30 of cylinder 28. Existing through the center of the top plate 34, and coaxially aligned with turret cylinder 28, is through bore 36. Axially disposed within both the bore 36 and the turret cylinder 28 is drive screw 38. Drive screw 38 is comprised of an elongated shaft having a top end 40 and bottom end 42. The top end 40 of the screw 38 is located above the top plate 34 while the bottom end 42 of the screw 38 is located within turret cylinder 28, proximal to the turret cylinder's bottom end 32.

Drive screw 38 is rotatably connected to top plate 34 via drive screw bearing 44 and bearing sleeve 46. Drive screw bearing 44 has an inner diameter that is rotatably disposed around the screw 38. The inner diameter of bearing 44 rests against the outer diameter of the screw 38 while the outer diameter of the bearing 44 rests against the inner diameter of the sleeve 46. The screw bearing 44 may include any type of suitable bearing configuration known in the art which allows for the relatively free rotation of the drive screw 38 within the bearing sleeve 46.

Bearing sleeve 46 is coaxially located within bore 36 of top plate 34, with the outer diameter of sleeve 36 resting against the inner diameter of top plate bore 36. The sleeve 46 has a flange 48 that rests against the top surface 49 of the top plate 34. One skilled in the art would recognize that flange 48 of the bearing sleeve may be secured to the top plate 34 with welds, bolts, or other similar means.

The drive screw 38 is threaded between the bottom end 42 and the bearing 44, located at the top plate 34 of the hollow column 28. Any type of drive thread may be utilized, including, but not limited to machine threads and ball screw threads.

A drive system of any suitable type known in the art can be employed to rotate the drive screw 38. For example, the drive screw 38 can be rotated by belt or chain 50 which is in turn operably connected to a drive motor 52. Alternatively, a suitable gear system (not shown) can be configured to rotate the drive screw 38. As illustrated in the preferred embodiment shown in FIG. 3, motor 52 is connected to top plate 34 via motor bracket 54.

Referring again to FIG. 2, operably associated with both the hollow column 28 and drive screw 38 is lift carriage 56. Lift carriage 56 is comprised of a threaded housing 58 having front and rear support rollers 60 and 62, respectively, attached thereto. The front and rear rollers 60 and 62 rotate against the inside surface 64 of the turret cylinder 28. The threaded housing 58 is threadedly engaged with the drive screw 38 such that a rotation of the drive screw 38 causes a vertical translational motion of the carriage 56 inside the hollow column 28, with the front and rear rollers 60 and 62 rolling along the length of the column's inner surface 64.

Figure 3:
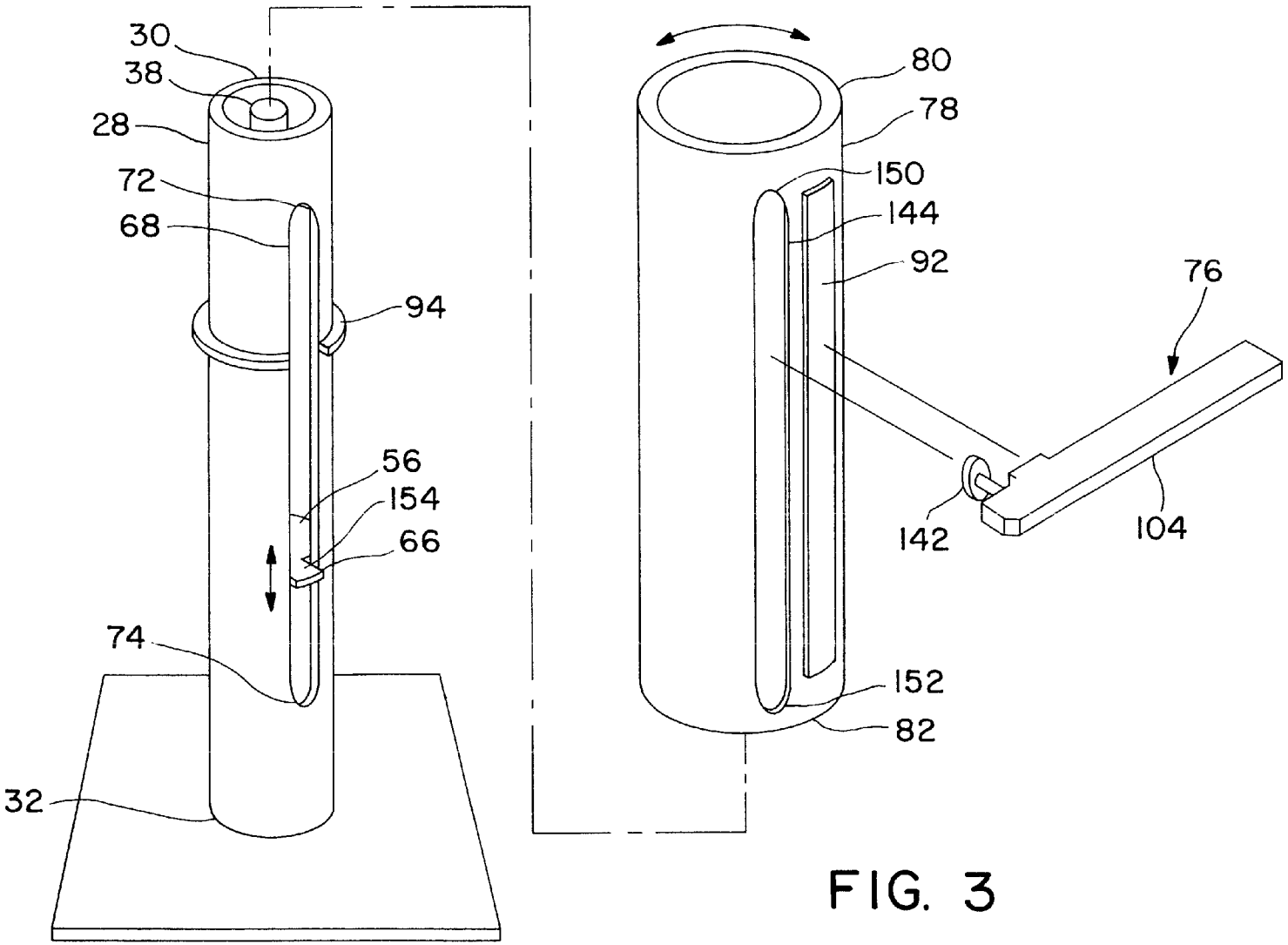
FIG. 3 is a perspective assembly drawing showing the hollow column, turret, lift arm assembly, and lift pin.

Adjacent to the front rollers 60 of the lift carriage 56 is lift pin 66. The lift pin 66 protrudes from the carriage 56, located inside the hollow column 28, and through a lengthwise, through pin slot 68 located in the surface of the hollow column 28 so that the pin 66 extends beyond the outer surface 70 of the column 28. Illustrated in more detail in FIG. 3, the lengthwise pin slot 68 extends vertically along the length of the hollow column 28 from a starting point 74 proximal to the hollow column's bottom end 32 to an ending point 72 proximal to the hollow column's top end 30. As illustrated in FIGS. 2 and 3, the lengthwise, through pin slot 68 provides a path to allow for the translational motion of the pin 66 outside the hollow column 28 as the pin 66, connected to the lift carriage 56, moves in translational motion due to the rotational motion of the drive screw 38. Thus, a forward or reverse rotation of the drive screw 38 will cause the pin 66 to vertically move within the pin slot 68 along the hollow column's length either towards the slot's starting point 74 or ending point 72, respectively.

Referring again to FIG. 2, turret 78 is both rotatably attached to the hollow column 28 and in coaxial relation therewith. The top end 80 of the turret 78 is located parallel to the top end 30 of the hollow column 28 while the bottom end 82 of the turret 78 is positioned in a location proximal to and below the starting point 74 of the hollow column's pin slot 68.

The turret 78 is rotatably attached to the hollow column 28 via top and bottom bearing rings 84 and 86, which are coaxially disposed between the hollow column 28 and turret 78 at the respective top and bottom ends, 80 and 82, of the turret 78. The top and bottom column bearing rings 84 and 86 can include any type of suitable bearing configuration known in the art which allows for the relatively free rotation of the turret 78 around the hollow column 28.

The top and bottom column bearing rings 84 and 86 rest on respective top and bottom collars 88 and 90. The top collar 88 is located at the top end 30 of the hollow column 28 while the bottom collar 90 is located on the hollow column 28 proximal to and below the location of the starting point 74 of the hollow column's pin slot 68. The collars are preferably both coaxial with and fixedly attached to the hollow column 28 at respective locations and have respective seats 92 and 94 having outer diameters larger than the inner diameter of the hollow column's rings 84 and 86.

Thus, because the outer diameter of the collar seats 92 and 94 are larger than the inner diameters of the bearing rings 84 and 86, the lower surface of each respective bearing ring rests on the upper surface of each respective collar seat.

With the inside diameter of the top and bottom bearing rings 84 and 86 fixedly secured to the collar seats 92 and 94 and the outer diameters of the rings 84 and 86 fixedly secured to the inner diameter of the turret 78, the turret 78 can rotate freely around the hollow column 28. In accordance with this relationship, the top and bottom collar seats 92 and 94 also vertically secure the freely rotating turret 78 to the stationary hollow column 28.

Referring now to FIG. 3, the lift arm assembly 76 is slidably attached to the turret 78 via a linear track 92. The linear track 92 extends vertically along the turret 78 from a location proximal to the bottom end 82 of the turret 78 to a location proximal to the upper end 80 of the turret 78. The path of the turret linear track 92 is parallel to that of the hollow column pin slot 68. The linear track 92 must both rigidly secure the lift arm assembly 76 to the turret 78 and facilitate the vertical translation of the assembly 76 along the turret 78.

The linear track 92 essentially takes the form of a guide on which the lift arm assembly 76 remains vertically seated. The guide can take the form of a number of embodiments in both supporting the lifting arm assembly 76 and allowing for its vertical translation along the hollow column 78. In the simplest embodiment, the linear track 92 can take the form of a double V-guide on which the lift arm assembly 76 is seated. Due to the heavy loads applied to the lifting arm assemblies in supporting a full roll of material, the preferred embodiment of the linear track 92 minimizes friction with the inclusion of roller or ball bearings (not shown) between the track 92 and lift arm assembly 76.

The lift arm assembly 76 is slidably connected to the turret 78 via the linear track such that the lift arm assembly 76 is movable between a position proximal to the bottom end 82 of the turret 78 and a position proximal to the turret's top end 80. When proximal to the turret's top end 80, the lift arm assembly 76 is movable around the hollow column 28 in conjunction with the rotary track, to be discussed further. When proximal to the turret's bottom end 82, the lift arm assembly 76 is in a position, entitled the "load" position, to accept the placement of a full roll of material therein.

Figure 4:
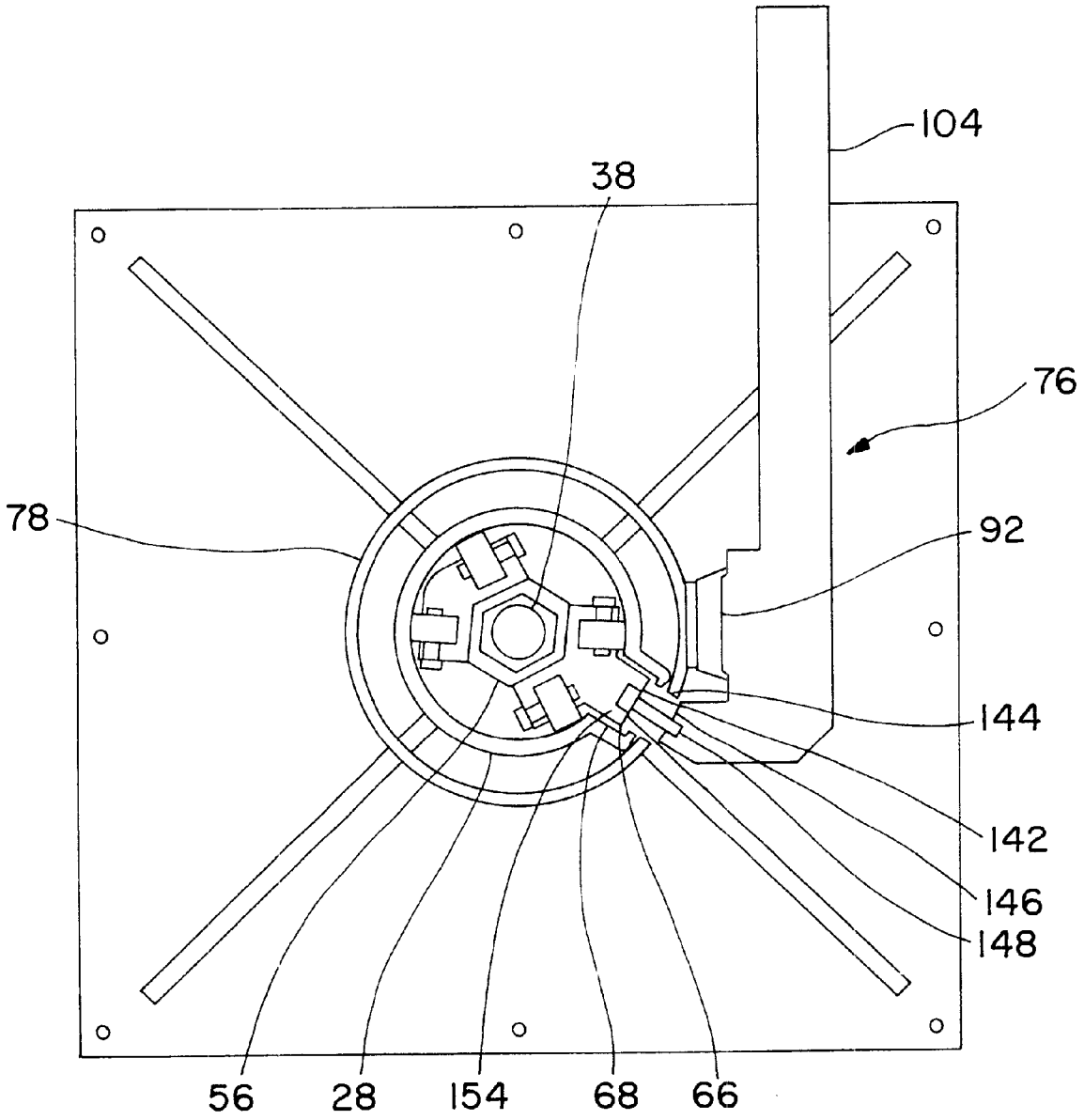
FIG. 4 is a top plan view of the apparatus showing the turret, hollow column (located within the turret), carriage (located within the hollow column) lift pin, and lift arm assembly.

Referring now to FIGS. 3 and 4, the lift arm assembly 76 includes a support arm track 104, having a protruding roller 142 extending therefrom at an end of the track 104 proximal to the turret 78. The roller 142 protrudes inwardly through roller slot 144 of the turret 78 for operable contact with lift pin 66, which in turn protrudes outwardly through pin slot 68 of the hollow column 28 from lifting carriage 56, which is located inside the hollow column 28.

In the preferred embodiment, the pin 66 has an upper surface 154 that serves as a platform upon which the roller 142 is seated. A forward or reverse rotation of the drive screw 38 will thus cause the pin 66, having the roller 142 seated thereon, to translate vertically up or down, thus raising or lowing the lift arm assembly 76 along the length of both the column 28 and turret 78. The lift arm assembly 76 can thus be raised from the starting point 152 of the roller slot 144 to the roller slot's ending point 150 (located proximal to the upper end of the turret 78) through the translation of the pin 66 from the starting point 74 of the pin slot 68 to the pin slot's ending point 72 (located proximal to the upper end of the hollow column 28).

Figure 5:
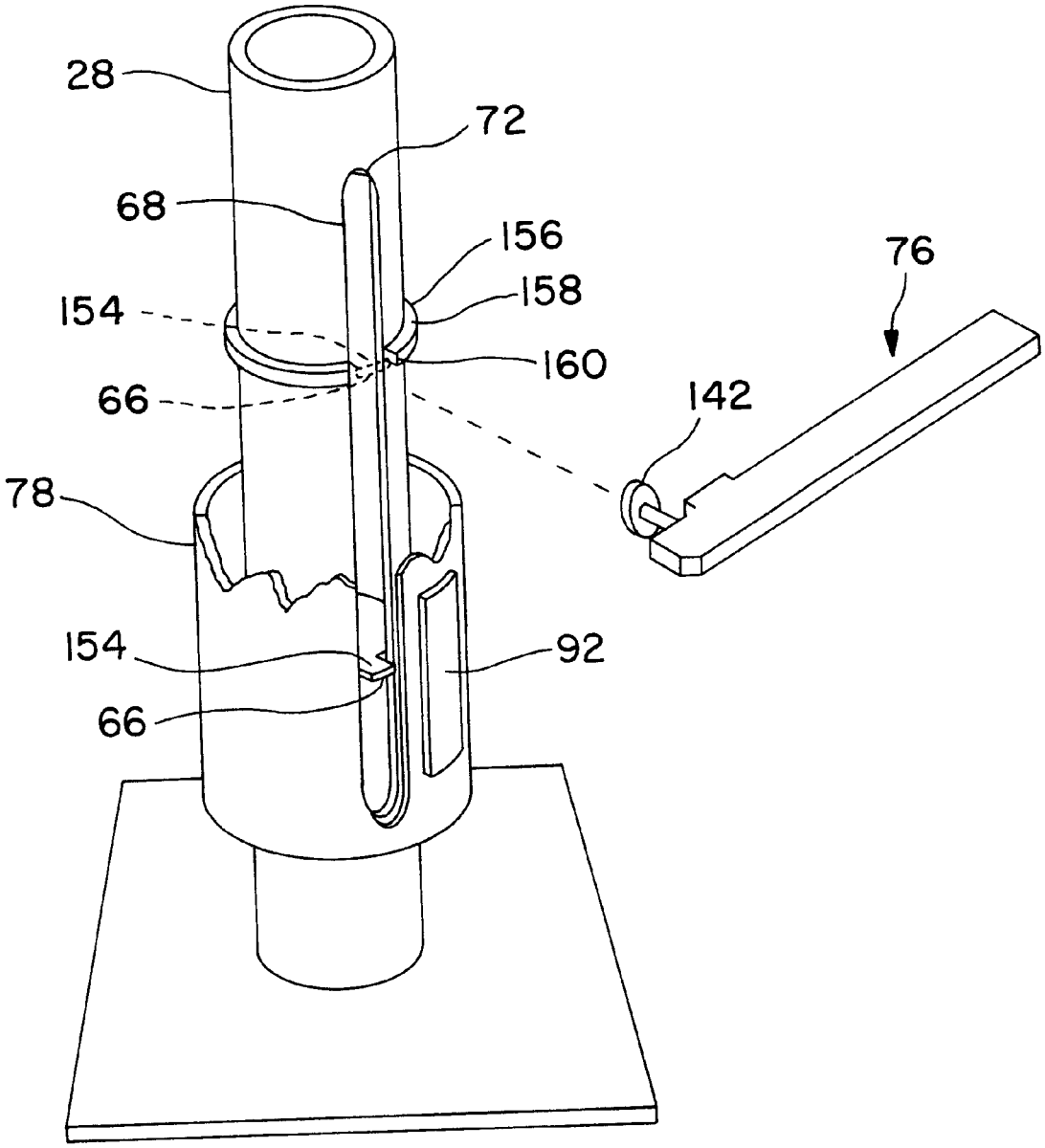
FIG. 5 is an exploded perspective view of the turret of the apparatus illustrating the rotary plate of the hollow column with related lift arm assembly.

Turning now to FIG. 5, located on hollow column 28, proximal to the ending point 72 of the pin slot 68, is rotary track 156. The rotary track 156 of the preferred embodiment is a generally flat, horizontal disk coaxially disposed around the turret shaft 28. The rotary track 156 has an upper surface 158 that is circumferentially continuous except for a generally rectangular cutout 160 within the surface 158 where the track 156 meets the pin slot 68 of the hollow column 28. The width of the cutout 160 is slightly larger than the width of the lift pin 66 to allow the lift pin 66 to vertically translate within the pin slot 68 at the point of intersection between the pin slot 68 and rotary track 156.

In the preferred embodiment of the invention, the pin 66 translates up and down the length of the hollow column 28 within the pin slot 68 and comes to a rest within the slot 68 when the upper surface 154 of the pin 66 is horizontally parallel with the upper surface 158 of the rotary track 156. With the pin upper surface 154 parallel with the track upper surface 158 within the rectangular cutout 160 of the track 156, a substantially continuous rotary surface is established around the hollow column 28. When in this parallel position, the roller 142 of the lift arm assembly 76, seated on the upper surface 154 of the lift pin 66, can be rolled off of the pin's upper surface 154 and onto the upper surface 158 of the rotary track 156.

Once the roller 142 is rolled onto the upper surface 158 of the rotary track 156, the roller 142 and attached lift arm assembly 76 are rotated around the rotary track 156 and hollow column 28 via a rotation of the turret 78. In the preferred embodiment of the invention, the lift arm assembly 76 is rotated around the hollow column 28 to a location that is 180 degrees from the cutout 160. Because the unwind operation occurs when the lift arm assembly is located within this position, the location is aptly referred to as the "unwind" position. While an unwind location existing 180 degrees from the cutout 160 is discussed herein, it is understood that additional unwind positions can be provided around the hollow column in any number of circumferential locations from the cutout 160.

Figure 6:
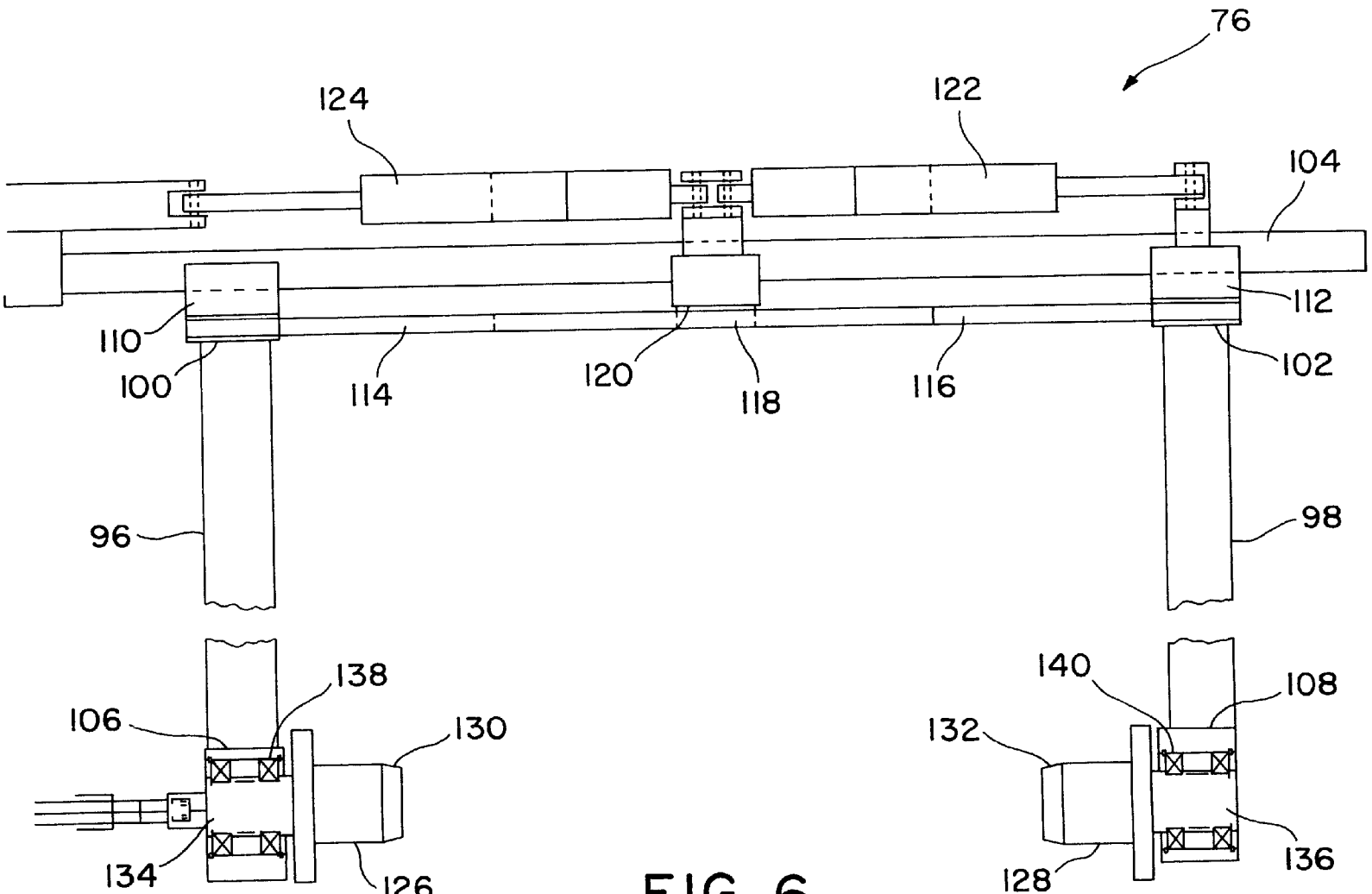
FIG. 6 is an elevational view of the lift arm assembly and related components.

Referring to FIG. 6, the lift arm assembly 76 includes two vertical support arms 96 and 98, in parallel relation to one another, which accept and support the roll of material therebetween during the loading and unwinding operations. Support arms 96 and 98 each have an upper end, 100 and 102, respectively, operably associated with a support arm track 104, and a lower end, 106 and 108, respectively, for supporting the roll (not shown). The support arms 96 and 98, mounted to the support arm track 104 at their respective upper ends 100 and 102, are slidably movable relative to one another along the support arm track 104. Preferably, the support arm track 104 comprises an elongated beam that is tangentially disposed in horizontal relation to the turret 78. However, it is understood that the support arm track can also be disposed perpendicular to the turret 78 as well.

Support arm linear bearings 110 and 112 are disposed at respective upper ends 100 and 102 of the support arms 96 and 98. The support arm linear bearings 110 and 112 are slidably engaged with the support arm track 104 to enable the arms 96 and 98 to move horizontally along the track 104. In addition to being slidably engaged with the support arm track 104, support arm linear bearings 110 and 112 are attached to respective rack gears 114 and 116 that extend horizontally towards each opposite support arm. Rack gears 114 and 116 are generally perpendicular to the lift arms 96 and 98, parallel to the lift arm track 104, and are in operable engagement with a common pinion gear 118.

In the preferred embodiment, the pinion gear 118 is located on, and in parallel relation to, the support arm track 104, midway between the support arm bearings 110 and 112. Because the rack gears 114 and 116 mesh with the pinion gear 118 on opposite sides of the pinion gear's axial center, a rotation of the pinion gear 118 will cause a horizontal translation of the rack gears 114 and 116 in a direction opposite of one another.

Upon further inspection of FIG. 6, it is apparent that pinion gear 118 is mounted to the support arm track 104 via a pinion gear linear bearing 120. The pinion gear linear bearing 120 enables the pinion gear 118 to translate horizontally along the length of the support arm track 104, for reasons to be discussed further.

The motion of the support arms 96 and 98 towards and away from one another via the rack and pinion gears 114, 116 and 118 is controlled by a roll clamp actuator 122. The roll clamp actuator 122 connects the pinion gear linear bearing 120 to the support arm linear bearing 112. The roll clamp actuator 122 of the preferred embodiment shown in FIG. 6 is an extendable and retractable piston. Alternatively, the roll clamp actuator 122 can comprise any mechanism that is capable of transmitting linear force, such as a machine screw or other mechanism. Although FIG. 6 shows actuator 122 connected to bearing 112, one of experience in the art will understand that actuator 122 can alternatively be connected to linear bearing 110.

Upon extension of the actuator 122, the lift arm linear bearing 112 is forced away from the pinion gear linear bearing 120 along the support arm track 104. As the lift arm linear bearing 112 is forced away, the attached rack gear 116 translates in the same direction and rotates the pinion gear 118, to which both rack gears 114 and 116 are meshed. Rotation of the pinion gear 118 by the actuated rack gear 116 thus causes the other rack gear 114 to move in a direction opposite of the actuated rack gear 116, resulting in the support arms 96 and 98 moving away from one another. As the rack and pinion system allows for the equidistant and opposite horizontal movement of the support arms 96 and 98, a retraction of the actuator 122 between the pinion gear linear bearing 120 and support arm linear bearing 112 thus results in the support arms 96 and 98 moving towards one another.

As mentioned previously, a pinion gear linear bearing 120 is slidably mounted to the lift arm track 104 between the lift arm linear bearings 110 and 112, with the roll clamp actuator 122 connecting the pinion gear linear bearing 120 to the support arm linear bearing 112. Further inspection of FIG. 6 yields that a web tracking actuator 124 is also connected to the pinion gear linear bearing 120, opposite the roll clamp actuator 122. Like the roll clamp actuator 122, the web tracking actuator 124 is also preferably embodied in the form of an extendable and retractable piston.

As shown in FIG. 6, one end of the web tracking actuator 124 is fixably attached to one end of the lift arm track 104 while the other end of the web tracking actuator 124 is attached to the pinion gear linear bearing 120. An extension or retraction of the web tracking actuator 124 slidably moves the pinion gear linear bearing 120, together with both support arm linear bearings 110 and 112 and respective support arms 96 and 98, translationally in a common direction along the length of the support arm track 104. This movement is used to linearly position the roll of material, once loaded between support arms 96 and 98, in the proper location in relation to the unwind stand during the unwinding operation, to be discussed further.

Regarding the interaction between the support arms 96 and 98 and the material roll, the lower ends 106 and 108 of each support arm include respective spindles 126 and 128. The spindles 126 and 128 are preferably cylindrical, with respective tapered leading ends 130 and 132, and are freely rotatable about respective spindle axles 134 and 136. The spindle axles 134 and 136 are substantially perpendicular to their respective support arms 96 and 98.

Spindle bearings 138 and 140 (or any other friction reducing mechanism known in the art) are used to provide for the relatively frictionless rotation of the spindles around their respective axles. The spindles 126 and 128 are inwardly located on each lift arm 96 and 98, directly across from each other, so as to be substantially coaxial. The spindles 126 and 128 are adapted for insertion into the hollow core of the roll, thereby supporting the roll at both ends of the hollow core without the use of a through shaft.

Due to the extreme weight of the full roll of material, a drive motor 162 is provided in the preferred embodiment of the invention shown in to rotate the roll in the unwind direction. Referring once again to FIG. 1, the drive motor 162, mounted to the hollow column 28, has a shaft 164 that is coaxial with the spindles of the lift arm 76 assembly when the assembly 76 is located in the unwind position. Shaft 164 is configured to operably engage the lift arm assembly spindle 126 that is located proximal to the hollow column 28. Although FIG. 1 shows the shaft driven indirectly by the motor via belt 163, one of experience in the art will understand that the motor 162 can directly drive the shaft 164 as well.

Figure 7:
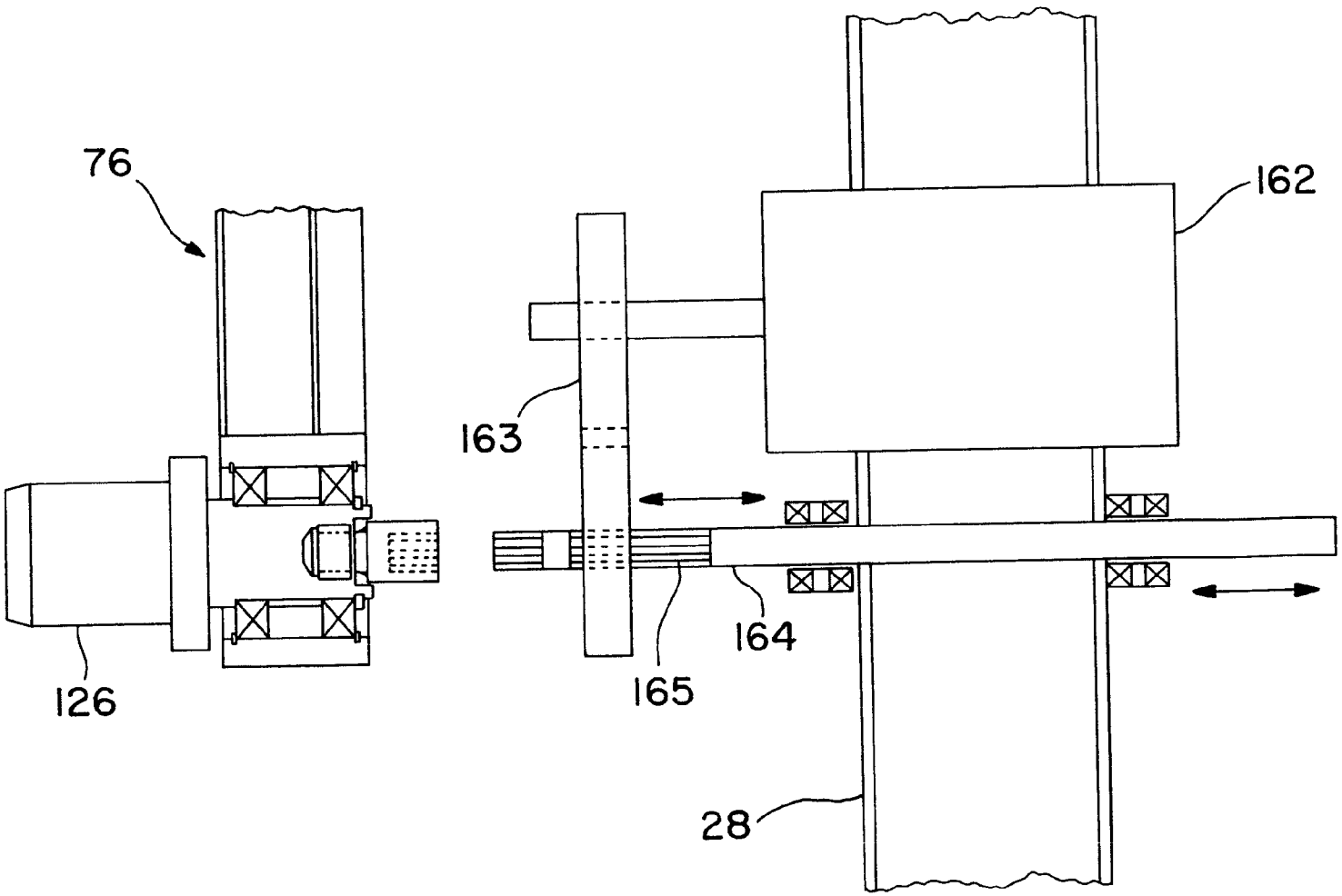
FIG. 7 is a detailed illustration of the drive motor, shaft and spindle of the apparatus illustrated in FIG. 1.

Referring now to FIG. 7, the shaft 164 has splines 165 to allow for axial translation of the shaft 164 between the hollow column 28 and lift arm assembly spindle 126. Such translation allows the shaft 164 to both extend from the hollow column 28 to the spindle 126 (for operable engagement with the spindle 126 during an unwind operation) and retract from the spindle 126 to the hollow column 28 (when moving the roll and lift arm assembly 76 to or from the unwind position).

In operation, the lift arm assembly is initially placed at the "load" position proximal to the bottom end of the hollow column. The roll clamp actuator is extended to move the support arms of the lift arm assembly apart from one another to accept the placement of a full roll of material therebetween. After a full roll of material is placed between the support arms, the roll clamp actuator is retracted to move the support arms towards one another. As the support arms move towards one another, the spindles are inserted into the core of the material roll to releasably and rotatably hold the roll between the support arms.

With the roller of the lift arm assembly seated on the lift pin, the drive screw is rotated to cause vertical translation of the carriage and lift pin. The vertically translating lift pin lifts the lift arm assembly from the load position proximal to the lower end of the hollow column to the rotary track, located proximal to the column's upper end. When the top surface of the lift pin is parallel with the top surface of the rotary track, the rotation of the drive screw is ceased, causing the vertical translation of the lift pin to stop.

Upon reaching the rotary track, the lift arm assembly roller is rolled off of the lift pin and onto the rotary track by rotating the lift arm assembly and turret around the hollow column. The lift arm assembly is rotated 180 degrees around the hollow column from the cutout of the rotary track to the unwind position.

Once the lift arm assembly, having the full roll loaded thereon, is placed in the unwind position, the web tracking actuator is extended or retracted to laterally move the support arms in a common direction along the support arm track for alignment of the material roll with the intake mechanism of a material processing machine (not shown). The splined drive shaft is then axially extended from the hollow column to the spindle located proximal to the turret for operable engagement with the spindle itself.

Upon engaging the spindle, the drive motor is started for rotation of the roll in the "unwind" direction. After all material has been unwound from the roll, the drive shaft is disengaged from the spindle and retracted back to the turret. The lift arm assembly, holding the empty core thereon, is rotated back 180 degrees on the rotary track of the column to the lift pin.

With the lift arm assembly roller again seated on the lift pin surface, the drive screw is rotated in a reverse direction, causing the lift pin and lift arm assembly to descend from the rotary track to the load position, proximal to the bottom end of the turret. The roll clamp actuator is again extended to cause the support arms of the lift arm assembly to move apart from one another, thereby removing the spindles from the empty core. After the empty core is removed, a full roll of material is then placed between the support arms of the lift arm assembly. The lift arm assembly is then moved again to the unwind position, via the lift pin and rotary track, where the unwind operation is repeated.

More than one lift arm assembly may be provided in the preferred embodiment of the invention. When additional lift arm assemblies are provided, a subsequent roll (or rolls) can be loaded onto the apparatus in advance of being unwound. While a roll is in the process of being unwound in the "unwind" position on the column, a subsequent, full roll can be loaded onto the apparatus in the "load" position, and held there until the roll located in the "unwind" position is fully unwound.

The subsequent, full roll is then moved from the "load" position to the rotary track via the lift pin. Upon reaching the rotary track, the lift arm assemblies, holding the full roll and the empty core, respectively, are each rotated around the hollow column so that the full roll is moved into the "unwind" position from the lift pin while the empty core is moved from the "unwind" position and into engagement with the lift pin. The unwinding of the full roll can thus commence while the lift pin lowers the empty core towards the turret's "load" position (for subsequent replacement with another full roll).

If an unwind application is to be continuous, an automatic splice device can be placed between two rolls of the material to be unwound. When one of the rolls is completely unwound, the leading edge of a full roll is automatically attached to the trailing edge of a spent or extinguished roll and the full roll is then accelerated to the speed of the processing machine.

The present self-lifting unwind stand is eminently well suited for such an application. In such an application two vertical turrets are utilized, each with a single lift arm assembly. A web preparation station is provided on the turret to hold the web in an appropriate position for the automatic splice.

If desired, the base for the vertical turrets can be mounted on a linear slide to provide for a movement of the lift arms in a linear path as well.

The foregoing description and the accompanying drawings are illustrative of the present invention. Still other variations and arrangements of parts are possible without departing from the spirit and scope of this invention.

We claim:

1. Apparatus for moving a roll of material from a load position to an unwind position, and comprising:

a base;

a hollow column extending upwardly from the base;

a rotary track around the column;

a lift carriage drive mounted to the column;

a turret rotatably mounted for movement around the column;

a lift carriage operably connected to the lift carriage drive, said carriage being movable by said drive along the column between said base and said rotary track; and a lift arm assembly for releasably and rotatably holding the roll of material, the assembly being slidably mounted to the turret and movable with said lift carriage along the column between said base and said rotary track, and rotatable together with said turret around said rotary track.

2. The apparatus of claim 1 wherein the drive comprises a drive screw coaxially and rotatably mounted within the column, said drive screw driven by a motor and meshed with the lift carriage whereby a rotation of the drive screw by the motor causes a linear translation of the carriage along the column.

3. The apparatus of claim 2 wherein the lift carriage comprises a threaded housing meshed with the drive screw; a plurality of rollers rotatably attached to the housing with said rollers in rolling contact with the column during said linear translation of the carriage; and a lift pin horizontally extending from the housing through a lengthwise pin slot located in the column, said pin having a substantially horizontal upper surface that extends outwardly through the pin slot and beyond the outer surface of the column.

4. The apparatus of claim 3 wherein the lift arm assembly comprises a support arm track; two generally parallel support arms; and a roller, each support arm having a lower end with a spindle rotatably mounted thereon for supporting the roll and an upper end operably associated with the support arm track, the support arms horizontally movable relative to one another along the support arm track whereby the support arms move away from one another to accept the roll and towards one another to releasably and rotatably hold the roll on the spindles, said roller rotatably mounted to the track and having an axle extending horizontally therefrom through a lengthwise roller slot located in the turret, said roller extending inwardly beyond the inner surface of the turret with the roller and pin falling on a common, vertically linear path between the hollow column and turret such that operable engagement can occur between the roller and the horizontal upper surface of the pin.

5. The apparatus of claim 1 further comprising a drive motor mounted to the column for turning the roll to unwind material therefrom and an extendable drive shaft having one end operably connected to the motor and the other end removably connectable to one of said spindles of the lift arm assembly whereby the shaft can extend from the motor to the spindle for connection thereto and retract from the spindle to the motor after disconnection from the spindle.

6. A method for moving a roll of material from a load position to an unwind position and turning the roll to unwind the material therefrom, using an apparatus including a lift arm assembly movably mounted on a hollow column, the lift arm assembly being movable both vertically along the column and rotatably around the column and having two generally parallel support arms movable laterally with respect to one another for holding the roll, and a drive motor for turning the roll, the method comprising the steps of:

(a) loading the roll of material between the support arms of the lift arm assembly while the lift arm assembly is located in the load position;

(b) moving the support arms toward each other to hold the roll;

(c) lifting the lift arm assembly along the column;

(d) rotating the lift arm assembly around the column to the unwind position;

(e) connecting a drive motor to the roll; and (f) rotating the roll with the drive motor to unwind material from the roll.

* * * * *